US005703748A

United States Patent [19]

Fulks et al.

[11] Patent Number: 5,703,748

[45] Date of Patent: Dec. 30, 1997

[54] SOLENOID DRIVER CIRCUIT AND METHOD

[75] Inventors: Gary Chris Fulks, Spring Valley; William Dale Cornwell, Jr., Beavercreek, both of Ohio

[73] Assignee: General Motors Corporation, Detroit, Mich.

[21] Appl. No.: 644,492

[22] Filed: May 10, 1996

[51] Int. Cl.[6] ..... H01H 47/28

[52] U.S. Cl. ..... 361/153; 361/154; 361/195

[58] Field of Search ..... 361/194, 195, 361/168.1, 154, 153, 203

[56] References Cited

U.S. PATENT DOCUMENTS

| | | | |
|---|---|---|---|
| 3,904,938 | 9/1975 | Martin | 361/154 |
| 4,234,903 | 11/1980 | Harper | 361/154 |
| 4,266,261 | 5/1981 | Streit et al. | 361/154 |
| 4,536,818 | 8/1985 | Nielsen | 361/154 |
| 4,729,056 | 3/1988 | Edwards et al. | 361/153 |
| 4,812,945 | 3/1989 | D'Onofrio | 361/154 |
| 5,381,297 | 1/1995 | Weber | 361/153 |
| 5,422,780 | 6/1995 | Lignar | 361/154 |

*Primary Examiner*—Jeffrey A. Gaffin
*Assistant Examiner*—Michael J. Sherry
*Attorney, Agent, or Firm*—Anthony Luke Simon

[57] ABSTRACT

A solenoid driver circuit is provided that operates a solenoid in a quiet operation by reducing solenoid armature velocity. A pulse signal and a ramp signal are provided by a frequency generator and a ramp generator, respectively. A frequency switching circuit receives the pulse and ramp signals and responsively provides a time varying pulse signal that has a duty cycle that decreases with time. A dwell circuit allows the frequency switching circuit to control the solenoid for a first time period and then provides an on signal to the solenoid, maintaining the solenoid in the on position. The solenoid driver circuit is particularly suitable for use with solenoid controlled valves.

3 Claims, 5 Drawing Sheets

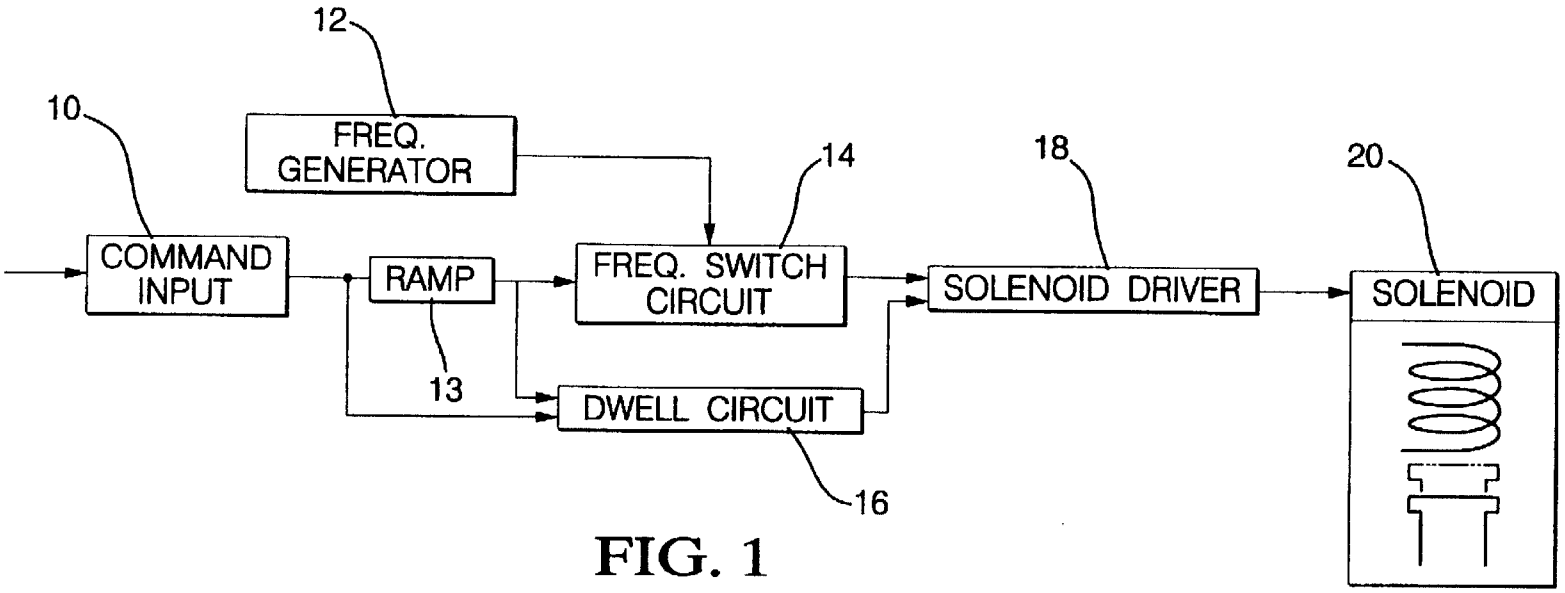
FIG. 1
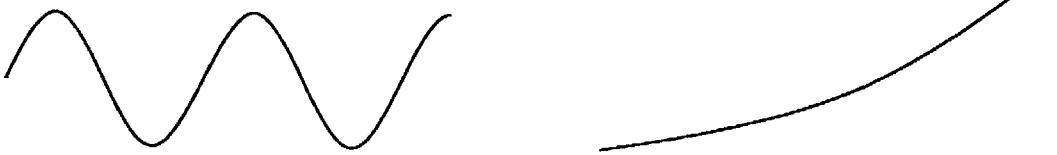
FIG. 2
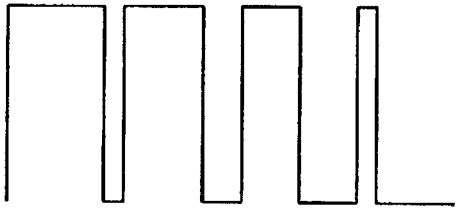
FIG. 3
FIG. 4

SOLENOID DRIVER CIRCUIT AND METHOD

This invention relates to a solenoid driver circuit and method.

BACKGROUND OF THE INVENTION

Many vehicle applications such as controllable suspension and brake systems require the use of solenoids to achieve controlled switching of hydraulic flow control valves. Conventional solenoid operation often results in switching noise that may be undesirable to the vehicle operator and passengers. Switching noise may be caused by mechanical noise of the solenoid armature striking a valve seat or other mechanical component within the solenoid or by other characteristics of the system.

Known methods of reducing solenoid switching noise include reducing the voltage applied to the solenoid and reducing the solenoid electromagnetic force, thereby reducing the speed of the armature and eliminating those noises caused by high speed armature impacts to valve seats. A limitation to these methods is that, while reducing supply voltage or electromagnetic force can significantly reduce armature speed and switching noises, it may also affect solenoid performance.

SUMMARY OF THE PRESENT INVENTION

Advantageously, this invention provides a solenoid driver circuit that reduces the armature velocity and increases armature transit time of the solenoid while, at the same time, ensuring high solenoid performance. By reducing the armature velocity and increasing transit time, components of solenoid noise are eliminated, resulting in a quieter solenoid especially suitable for use in automotive systems.

Advantageously, according to a preferred example of this invention, a solenoid driver circuit is provided including a frequency generator, a ramp circuit, a frequency switching circuit and a dwell circuit. The frequency generator generates a pulse signal at a fixed frequency and provides that signal to the frequency switching circuit. In response to a solenoid command input, the ramp circuit provides a ramped signal to the frequency switching circuit, which combines the ramp signal and pulse signal to provide to the solenoid a time varying pulse signal having a duty cycle that decreases with time. The dwell circuit also operates in response to the command input and, when first activated, allows the frequency switch circuit to control the solenoid. After a predetermined time period though, the dwell circuit forces the solenoid fully on to maintain the solenoid in the on position.

Advantageously, according to another preferred example, this invention provides a solenoid driver method comprising the steps of: receiving a solenoid on command; responsive to the solenoid on command, applying a signal to a solenoid having a first average voltage, causing an armature within the solenoid to begin moving; time varying the signal, wherein the average voltage decreases with time, wherein the armature continues movement to the on position but does not attain excessive speed and wherein solenoid noise is reduced; and, after a predetermined delay, applying a steady state on voltage to the solenoid to maintain the armature in the on position.

An advantage provided by this invention is that, when the solenoid is first turned on, it is supplied with a high duty cycle signal, providing a high average voltage ensuring that the solenoid armature begins moving. The duty cycle then decreases, decreasing the average voltage to the armature to prevent the armature from attaining excessive speed, while ensuring that the armature continues moving. After the dwell period is over, the voltage is then returned to a steady-state on value to maintain the solenoid armature in the on position.

BRIEF DESCRIPTION OF THE INVENTION

The present invention will now be described, by way of example, with reference to the following drawings in which:

FIG. 1 illustrates a schematic of an example solenoid driver circuit according to this invention;

FIGS. 2, 3 and 4 illustrate example signals generated by this invention;

Figure 5:
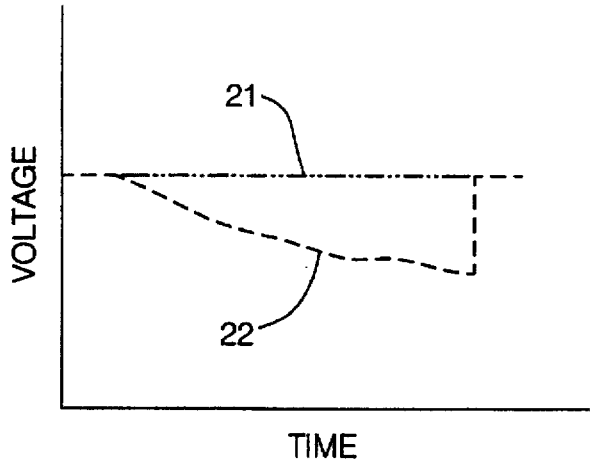
Figure 6:
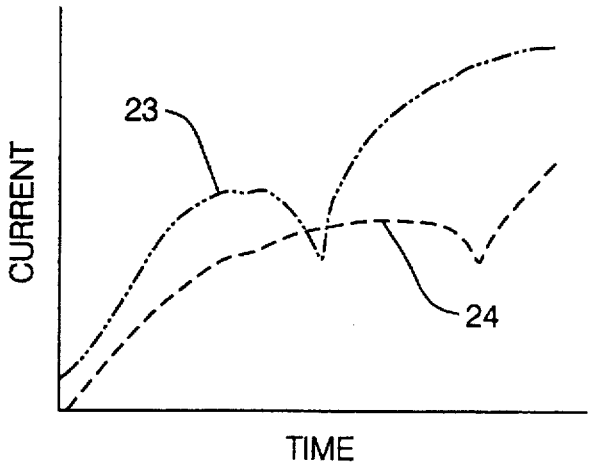
Figure 7:
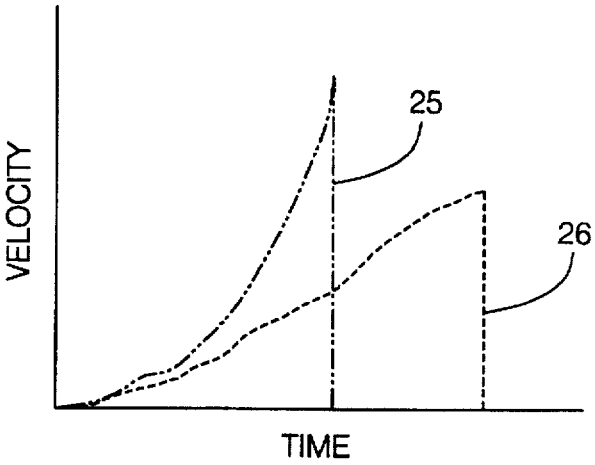
Figure 8:
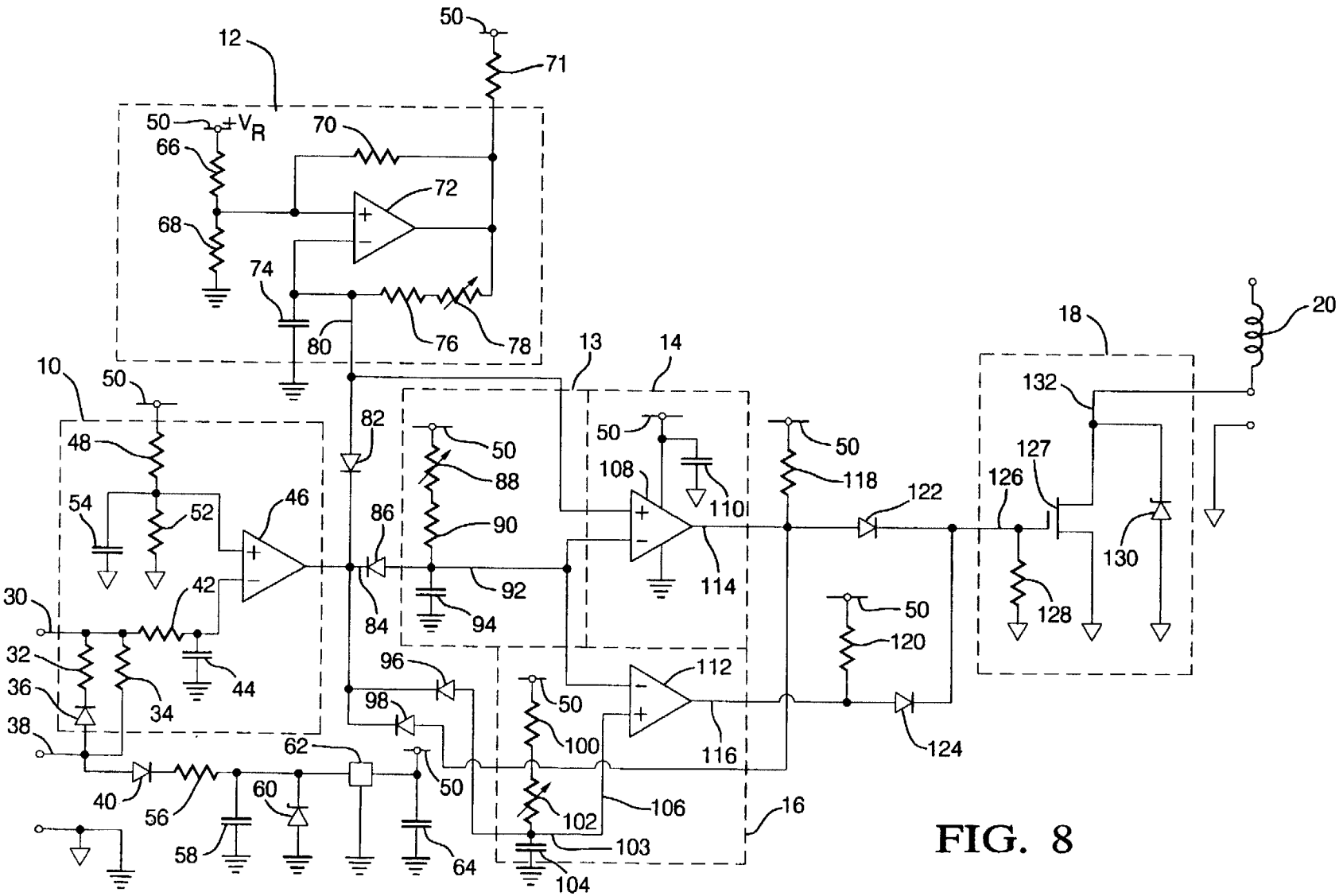
Figure 9:
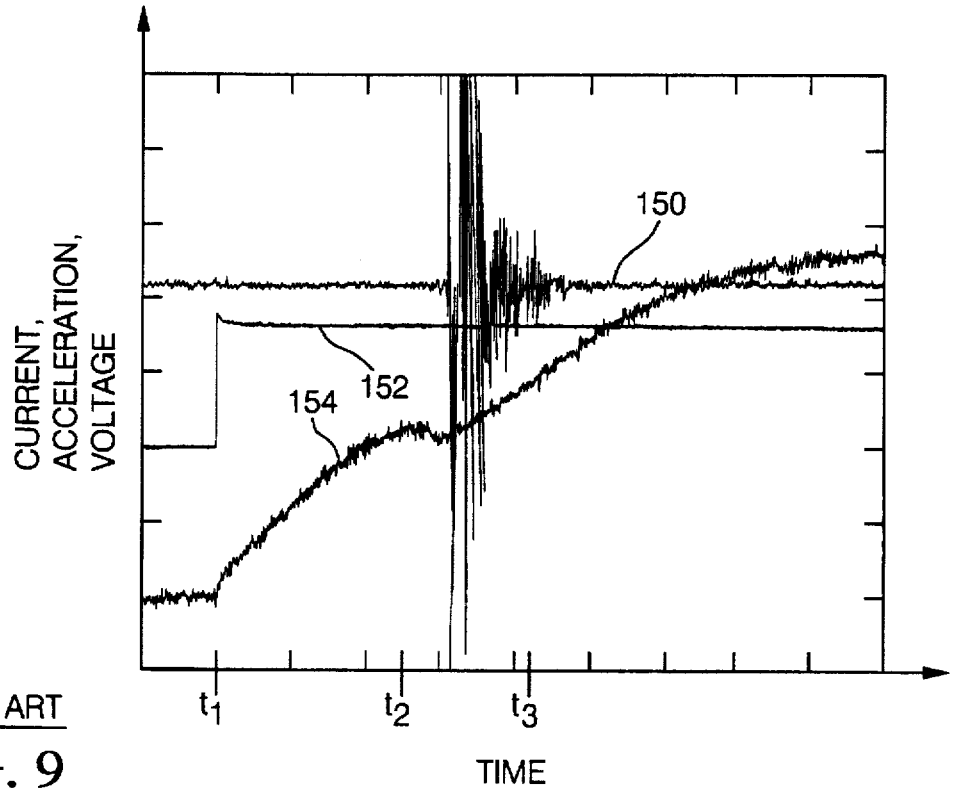
PRIOR ART FIG. 9
Figure 10:
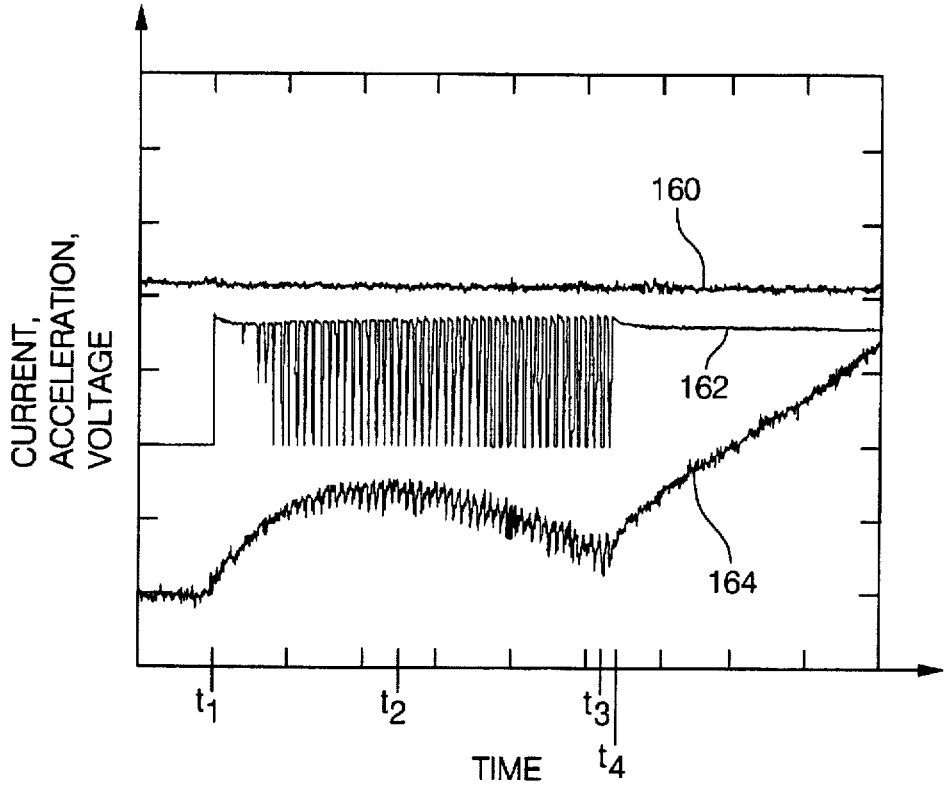
Figure 11:
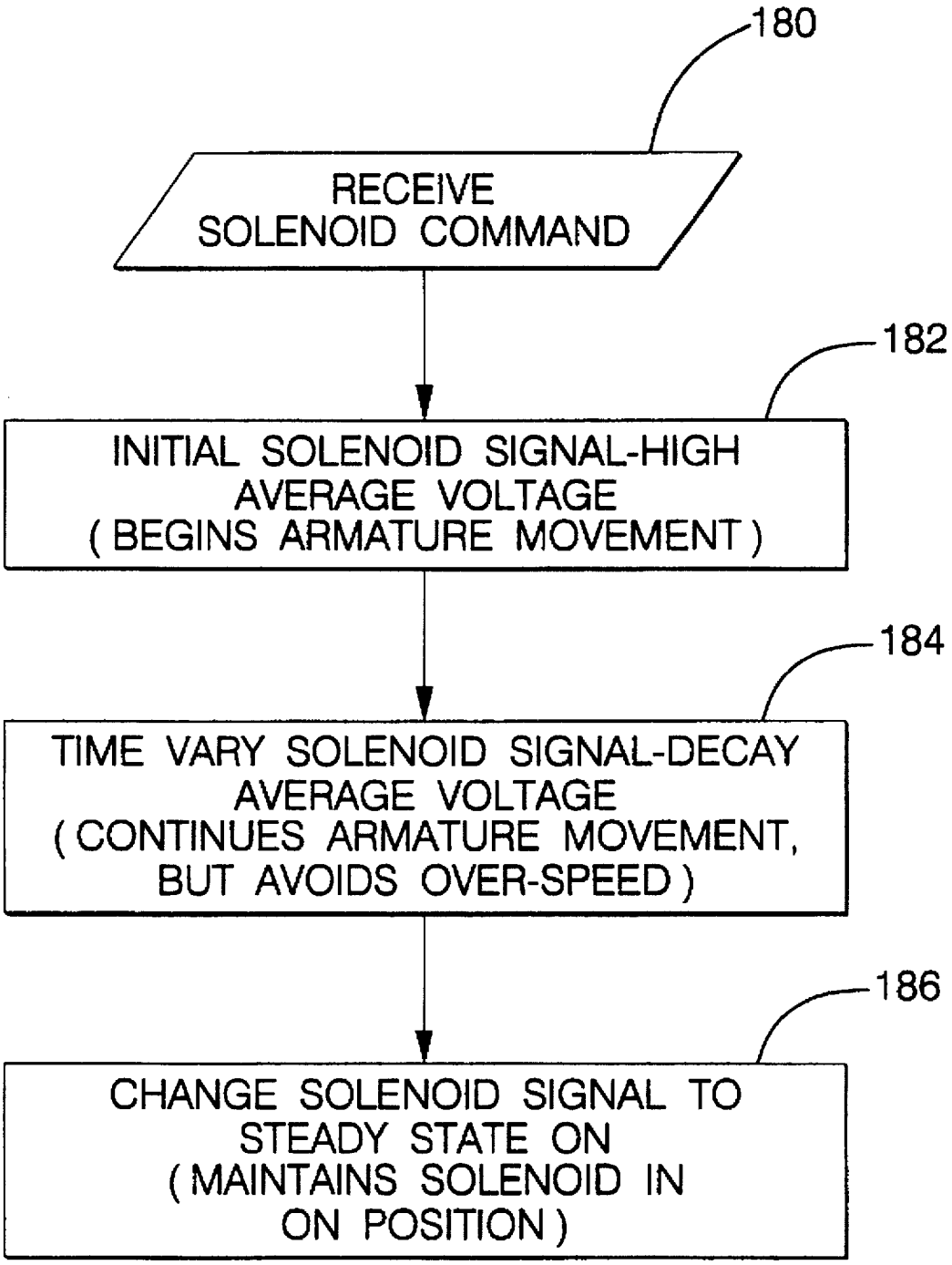

FIGS. 5, 6 and 7 compare example voltage, current and armature velocity profiles of a solenoid operated according to this invention to a solenoid operated according to example prior art;

FIG. 8 illustrates an example circuit implementation of this invention;

FIGS. 9 illustrates prior art solenoid operation and noise generated thereby;

FIG. 10 illustrates example solenoid operation according to this invention and noise reduction achieved thereby; and FIG. 11 illustrates an example method according to this invention.

DETAILED DESCRIPTION OF THE INVENTION

Referring now to FIG. 1, the example schematic according to this invention shown includes frequency generator circuit 12, frequency switching circuit 14, ramp circuit 13, dwell circuit 16, and solenoid driver 18 for driving solenoid 20. A solenoid command from any source such as a manual switch or a microprocessor-based controller is provided to the command input circuit 10. The command input circuit responsively provides a signal to the ramp circuit 13 and the dwell circuit 16, indicating that the solenoid has been commanded on. The ramp circuit 13 sends a ramp signal to the frequency switching circuit 14, which continuously receives a pulse signal from the frequency generator circuit 12. An example of the ramp signal is shown in FIG. 3.

Typically, the pulse signal from the frequency generator circuit will be in the range of 2–20 $K_{Hz}$. The pulse signal may have a wave form, for example, that is sinusoidal or triangular. An example sinusoidal wave form output from frequency generator 12 is shown in FIG. 2. The frequency switching circuit 14 combines the signal from the frequency generator 12 with the signal from the ramp circuit 13, for example, using a differential amplifier, and provides a time-varying pulsed output signal having a duty cycle that decreases with time. An illustrative example of the pulsed output signal from the frequency switching circuit 14 is shown in FIG. 4. The example in FIG. 4 is for illustrative purposes, in actual implementation the frequency is much higher and the decrease in duty cycle occurs over a larger span of pulse cycles.

The dwell circuit 16 provides no output affecting the solenoid during a first time period (delay period) after receiving the solenoid on command. After the end of the first time period, however, the dwell circuit 16 provides an output signal taking over control of the solenoid. The output signal goes to solenoid driver 18 and commands that the solenoid 20 be driven full on and maintained on at full voltage.

The results of this invention can be seen with respect to FIGS. 5, 6 and 7. Referring to FIG. 5, trace 21 illustrates the conventional voltage control for an on/off solenoid. At time $t_0$ the voltage goes up to the high level represented by trace 21 and stays there at a steady state until the solenoid is turned off. According to this invention, the average voltage provided to the solenoid goes high when the solenoid on command is first received, gradually reduces while the solenoid armature is in transition and then returns to the high level after or near the time of completion of travel by the armature to secure the armature in the solenoid-on position.

Referring now to FIG. 6, trace 23 represents typical prior art solenoid current when the voltage, according to trace 21 in FIG. 5, is applied. Trace 24 illustrates the solenoid current when the voltage according to this invention, i.e., as shown by trace 22 in FIG. 5, is applied. The result of the solenoid operation according to this invention is the velocity profile represented by trace 26 in FIG. 7. Trace 26 contrasts to trace 25, which illustrates the velocity profile of the solenoid armature when driven in the conventional manner, for example, with a voltage signal represented by trace 21 in FIG. 5.

As can be seen by comparing traces 25 and 26, according to this invention, the solenoid transient time is increased and the peak armature velocity is decreased, resulting in a lower solenoid noise. All of this is obtained without reducing steady state the solenoid voltage but instead by applying a voltage that peaks, gradually reduces and then returns to the peak voltage. This ensures reliable operation of the solenoid while reducing the solenoid noise.

Referring now to FIG. 8, the example circuit shown is suitable for use in driving a solenoid in a motor vehicle system environment and may be used with solenoids such as are included in controllable suspension and/or brake systems. The circuit receives power from the vehicle power supply through line 38, which is coupled through diode 40, resistor 56, capacitor 58 and diode 60 to voltage regulator circuit 62 of a type well known and commercially available to those skilled in the art.

The voltage regulator circuit 62 provides an output supply voltage on line 50 that is a regulated at a fixed voltage level of, for example, eight volts. Capacitor 64, for example, 100 μF, is used to stabilize the regulated voltage supply, line 50. The command input circuit 10 receives the signal on line 30 commanding the solenoid 20 to either on or off. Line 30 is normally high, corresponding to the solenoid being off, and the command signal pulls line 30 low when it is desirable to turn the solenoid 20 on. The input line 30 is biased high by diode 36 and resistors 32 and 34 connected to line 38 and is coupled to the inverting input of differential amplifier 46 by resistors 42 and capacitor 44. The non-inverting input to differential amplifier 46 is biased by resistors 48 and 52 connected between line 50 and ground and stabilized by capacitor 54. In general, line 30 is high when the solenoid is commanded off, in which event the output of differential amplifier 46, which is the output of command input circuit 10, is low. When line 30 is brought low, the output of the command input circuit 10, line 84 goes high.

Frequency generator circuit 12 comprises a differential amplifier 72, resistors 66, 68, 70, 76 and 78 and capacitor 74, connected as shown, and is powered by line 50 to provide a triangular waveform output signal on line 80 having a frequency between 2 and 20 KHz, depending on the values chosen for resistors 76 and 78. Line 80, the output of the frequency generator circuit 12, is coupled to the non-inverting input of differential amplifier 108 in the frequency switching circuit 14 and through diode 82 to line 84.

When line 84 is low, diode 84 ties line 80 low, maintaining the non-inverting input of differential amplifier 18 in the frequency switching circuit 14 low. When line 30 goes low, indicating a command to turn solenoid 20 on, and differential amplifier 46 responsively brings line 84 high, frequency signals from the frequency generator can then be sent through line 80 to the non-inverting input of differential amplifier 18.

Line 84 is also coupled to the ramp circuit 13 through diode 86. The ramp circuit 13 includes resistors 88 and 90 connected in series between line 50 and line 92. Capacitor 94 is connected between line 92 and ground.

When the solenoid command on line 30 commands the solenoid 20 to be off, line 84 is low and capacitor 94 is discharged and maintained discharged via diode 86. When line 84 goes high due to a solenoid "on" command on line 30, resistors 88 and 90 begin charging capacitor 94, providing a ramp up signal on line 92. The time constant for the ramp up signal is typically in the range of 2–20 milliseconds and may vary from system to system as the system designer desires, depending on the values of the resistors 88 and 90, and depending upon the characteristics of the particular solenoid used. Thus, when line 84 first goes high, line 92 is low and line 80 is enabled to transfer the pulses from the frequency generator 12 to differential amplifier 108.

Differential amplifier 108, coupled between line 50 and ground and stabilized by capacitor 110, is responsive to the signals on line 80 to provide the output pulse signals on line 114, which is biased normally high by resistor 118. Line 114 is connected by diode 122 to line 126 which is biased to ground by resistor 128 within the solenoid driver circuit 18.

The solenoid driver circuit comprises power transistor 127, which is switched on and off by the output of differential amplifier 108, selectively coupling solenoid 20 to ground, thus energizing solenoid 20 at the pulse rate and duty cycle of the output pulses on line 114.

As the voltage across capacitor 94 in the ramp circuit 13 begins ramping up, the differential amplifier 108 turns on and off at different points during the waveform of the signal on line 80 so that the signal on line 114 gradually decreases in duty cycle from its initial duty cycle of nearly 100%. The result is that the duty cycle of solenoid 20 is gradually reduced so that the average voltage to solenoid 20 first peaks when the solenoid on command is initiated and then begins declining.

Line 84, the output of the command input circuit 10, is also coupled to the dwell circuit 16 through diode 96. Within the dwell circuit 16, line 103 is connected to line 50 through resistors 102 and 100 and capacitor 104 is connected between line 103 and ground. Line 103 is connected to the non-inverting input of differential amplifier 112. During the ramp up phase of line 92, the output of differential amplifier 112 on line 116 remains low, during which time, line 114 controls the switching of transistor 127 and the energization of the solenoid 20. Once line 92 ramps up to a predetermined level, differential amplifier 112 provides a high output on line 116, which is coupled through diode 124 to line 126, thus maintaining line 126 high. When line 126 is maintained high, power transistor 127 is biased on so that solenoid 20 is energized at a steady-state on voltage.

This is the solenoid full on state and is timed to occur after the solenoid armature reaches its full travel. In this example, the full on state is characterized by the solenoid receiving its normally full voltage. In other examples, if system characteristics permit, the full on state may be characterized by application of a lesser average voltage to the solenoid, as, in some systems, it takes less power to switch the solenoid than it does to maintain the solenoid fully on.

Diode 130 connected between line 132 and ground is a zenor diode allowing free-wheeling current to flow past transistor 127 and preventing voltage spikes from damaging transistor 127.

Referring now to FIG. 9, an example of the operation of prior art solenoid control is shown. Trace 152 illustrates a conventional voltage input to a solenoid shown going from low to high at time $t_1$. Trace 154 illustrates the current of the solenoid responsive to the voltage input. Trace 150 is taken from an accelerometer placed on the solenoid and illustrates the generation of solenoid noise between times $t_2$ and $t_3$ due to the fast speed of the solenoid armature.

Referring now to FIG. 10, the operation of the present invention is shown. At time $t_1$, the solenoid is initially commanded on and the voltage trace 162 goes high at virtually 100% duty cycle. As can be seen, the duty cycle gradually reduces and, by time $t_2$ is approximately 60%. At time $t_3$, the solenoid voltage goes steady state high, responsive to the output from the dwell circuit 16. Trace 164 illustrates the current of the solenoid in responsive to the voltage control according to this invention. As can be seen, the current begins to rise at time $t_1$ then begins to fall after time $t_2$ as the duty cycle of the voltage applied to the solenoid decreases, and then begins to rise again at time $t_4$ as the voltage goes to a steady state high level. The results of this are the improved velocity response of the solenoid, improved in this case meaning a slower travel velocity of the armature, decreasing solenoid noise while maintaining reliable performance of the solenoid. This is illustrated by trace 160, showing that the accelerometer attached to the solenoid registers very little noise when the armature reaches its full travel position.

One skilled in the art will recognize that the above described examples of this invention are embodied in the solenoid driver method shown in figure 11. Referring to FIG. 11, when a solenoid on command is received (block 180), an initial signal having a high average voltage is applied to the solenoid (block 182), to begin armature movement. Then, at block 184, the solenoid signal is time varied, so that the average voltage of the solenoid decays. This continues the armature movement but does not over-accelerate the armature or cause the armature to attain excessive speed. This minimizes the contact velocity between the armature and the seat or other structure within the solenoid against which the armature comes to a rest. During this time, the armature moves to the full on position. At block 186, the armature voltage is changed to a steady state on voltage to maintain the armature in the on position, resulting in highly reliable switching of the solenoid without generation of undesirable excess switching noise.

In the above described example, the signal to the solenoid is a voltage signal and the time average voltage decays, decaying power to the solenoid (block 184). In an alternative example, the signal to the solenoid may be controlled so that the time average current to the solenoid decays.

We claim:

1. A solenoid driver circuit comprising:

a frequency generator providing an output pulse signal;

a ramp circuit receiving an input command and responsively providing a ramp signal;

a frequency switching circuit coupled to the ramp circuit and frequency generator receiving the ramp and pulse signals and responsively providing a time varying pulse signal to a solenoid, wherein the time varying pulse signal has an initial duty cycle and then decreases with time;

a dwell circuit, receiving the input command and responsive thereto, for a first time period allowing the frequency switching circuit to control the solenoid and then, after the first time period, providing an on signal to the solenoid, maintaining the solenoid in the on position.

2. A solenoid driver circuit according to claim 1, wherein the time varying pulse signal, with its initial duty cycle, begins movement of an armature within the solenoid, wherein, the decrease in the duty cycle of the time varying pulse signal ensures that the armature continues movement but does not attain excessive speed, wherein solenoid noise is decreased.

3. A solenoid driver method comprising the steps of:

receiving a solenoid on command;

responsive to the solenoid on command, applying a pulse width modulated voltage signal having an average voltage to a solenoid, wherein the pulse width modulated voltage signal has a duty cycle at a first level and wherein, responsive to the pulse width modulated voltage signal, an armature within the solenoid begins moving;

time varying the pulse width modulated voltage signal by gradually reducing the duty cycle below the first level over a predetermined period of time during movement of the armature, wherein the average voltage or current decreases during the predetermined period of time, wherein the armature continues movement to an on position but is not over-accelerated and wherein solenoid noise is reduced; and after the predetermined delayl period of time, terminating the pulse width modulated voltage signal and applying a steady state on voltage to the solenoid to maintain the armature in the on position.

* * * * *